United States Patent [19]

Egelstad

[11] Patent Number: 4,835,879

[45] Date of Patent: Jun. 6, 1989

[54] SCENTED PAD FOR HAND-HELD HAIR DRYERS

[76] Inventor: Randi K. Egelstad, 1006 First St., Snohomish, Wash. 98290

[21] Appl. No.: 177,965

[22] Filed: Apr. 5, 1988

[51] Int. Cl.[4] ..... F26B 21/06

[52] U.S. Cl. ..... 34/97; 34/72; 34/90; 219/362

[58] Field of Search ..... 422/124, 125; 34/90, 34/72, 19, 96, 97; 219/362

[56] References Cited

U.S. PATENT DOCUMENTS 1,727,212 9/1929 Martin ..... 34/72 X 4,383,377 5/1983 Crafton ..... 34/90 X

*Primary Examiner*—Henry A. Bennet

*Attorney, Agent, or Firm*—Seed and Berry

[57] ABSTRACT

A novel pad assembly is provided for use with a standard hand-held hair dryer to aid in removing undesired odors from a beauty salon. The pad assembly of the present invention is provided for use with standard hand-held hair dryers which include an aperture for supplying a heated air stream and a barrier attached to the aperture for preventing objects from entering into or passing out of the hair dryer. The pad assembly includes a pad portion made of a flame retardant, liquid absorbent material which is sized to fit within the aperture of the hair dryer. The pad portion has a backing attached thereto. The backing has an outer surface on which is disposed an adhesive material for mounting the pad assembly to the barrier of the hair dryer. An oil based scented liquid material is disposed within and absorbed by the pad such that a scent is released to the heated air stream upon use of the hair dryer.

10 Claims, 1 Drawing Sheet

SCENTED PAD FOR HAND-HELD HAIR DRYERS

TECHNICAL FIELD

The present invention is directed toward apparatus for providing a scent to areas wherein a hair dryer is used and, more particularly, toward a scented pad for use with a standard hand-held hair dryer for providing a scent to areas wherein the hair dryer is used.

BACKGROUND OF THE INVENTION

The "perm" and drying hair odors which are typically found in a beauty salon is known to be the number one complaint of salon customers. While several methods and apparatus are presently available for combating this problem, none presently known have been found to be completely acceptable as will be described below.

One method for combating the smell typically found in beauty salons is to use traditional air scenting techniques, such as aerosol deodorizers, and other similar type of room deodorizers. This method is practically ineffective against the ever present odor of the beauty salon. Further, these methods require the attention of salon personnel thereby reducing time which the personnel can use to perform their normal duties.

Another method and apparatus for reducing undesirable odors in a beauty salon can be found in Fluegel, U.S. Pat. No. 2,481,407. Fluegel discloses a hair drying device which includes a mesh-like material 46 that diffuses incoming air and also acts as an air silencer. The mesh-like material 46 may also serve to retain sachet 48 or, or the like, for scenting the drying air. The apparatus disclosed in Fluegel, however, is not readily adapted for use with a standard hand-held hair dryer as is commonly used in present day beauty salons. Further, the apparatus disclosed by Fluegel requires a retaining barrier, such as mesh-like material 46 to retain the sachet 48 from being influenced by the flow of heated air.

Other apparatus for combining spray from an aerosol can with the heated air stream of a hair dryer is disclosed in Bolton, U.S. Pat. No. 4,523,080. Bolton discloses a hand-held hair dryer which is adapted to receive an aerosol can for supplying a composition contained within the aerosol can to the hair or scalp. Bolton, however, requires a specialized hand-held hair dryer which is particularly adapted to attach an aersol can to the hair dryer and includes means for activating the release mechanism of the can. Accordingly, the apparatus disclosed by Bolton does not allow for scenting of a beauty salon using a standard hand-held hair drying device.

Other apparatus has been disclosed for performing functions similar to those performed by the disclosures of Fluegel and Bolton, but, however, none of these disclosures provide apparatus which can be used in combination with a standard hand-held hair dryer to eliminate the odors presently found in beauty salons.

It is, therefore, desirable to provide apparatus for eliminating undesirable odors found in beauty salons. It is, further desirable to provide apparatus which can be readily used with standard hand-held hair dryers to reduce or eliminate undesirable odors presently found in beauty salons.

DISCLOSURE OF THE INVENTION

The present invention provides apparatus for providing a scent to areas wherein a hair dryer is used. The hair dryer which can be used with apparatus of the present invention is of the standard hand-held type which has an aperture for supplying a stream of heated air. The hair dryer also includes a barrier for preventing objects from entering into or passing out of the aperture. The barrier includes an outer portion which is securely attached to the hair dryer aperture and an interior portion through which the heated air stream passes. The apparatus comprises a scentable pad which is sized to fit within the aperture of the hair dryer and which has first and second opposing sides. A backing is attached to the second side of the pad and has an outer surface which faces away from the pad. The outer surface of the backing has an adhesive material disposed thereon such that when the pad is pressed against the barrier of the hair dryer aperture, the backing attaches the pad to the barrier by the adhesive.

In further embodiments of the invention, a protective covering may also be provided which is attachable to the outer surface of the backing to protect the adhesive and prevent the pad from being inadvertently attached to objects other than the hair dryer. In still a further embodiment, the pad, the backing and the protective covering may include coaxial apertures through which at least a portion of the heated air stream can pass when the pad is mounted to the hair dryer aperture.

BEST MODE FOR CARRYING OUT THE INVENTION

Figure 1:
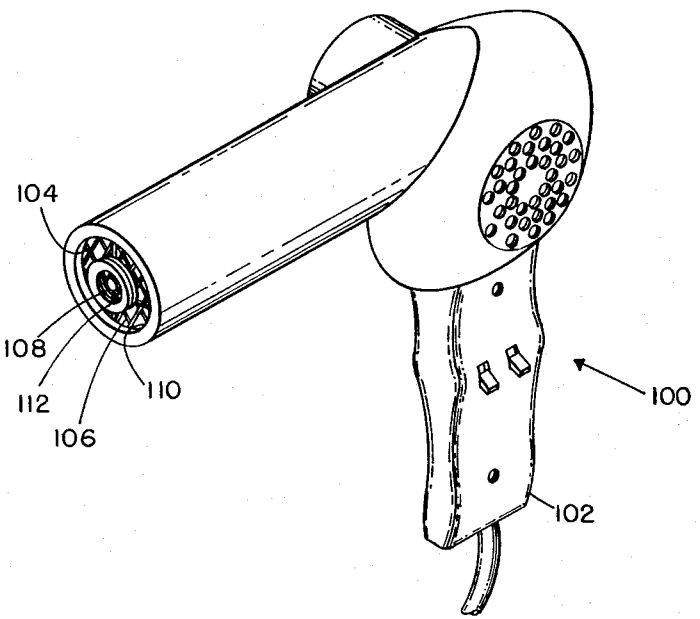
FIG. 1 is a perspective view of a standard hand-held hair dryer to which is attached the scented pad which comprises the present invention.

The present invention comprises a pad assembly which is mountable to a standard hand-held hair dryer to aid in scenting a beauty salon. A standard hand-held hair dryer to which the pad assembly of the present invention is adapted to be mounted is shown in FIG. 1. Therein, a hair dryer 100 includes a handle portion 102 which is gripped by a user when the hair dryer is in use. The hair dryer 100 also includes an aperture 104 which supplies a stream of heated air for drying the user's hair. A barrier 106 includes an inner portion 108 and an outer portion 110 wherein the outer portion 110 is securely attached to the aperture 104. The barrier 106 is provided for preventing foreign objects from entering into or passing out of the hair dryer aperture 104. While the barrier 106 is shown and described herein by reference to a wire grid, it will be appreciated by those skilled in the art that the invention may be used with hand-held hair dryers which include a variety of barriers. As an example, hair dryers which include plastic ridges as the barrier may be used with the subject invention. Many other variations upon barrier 106 may be provided in standard hair dryers and used with the pad assembly of the present invention.

Figure 2:
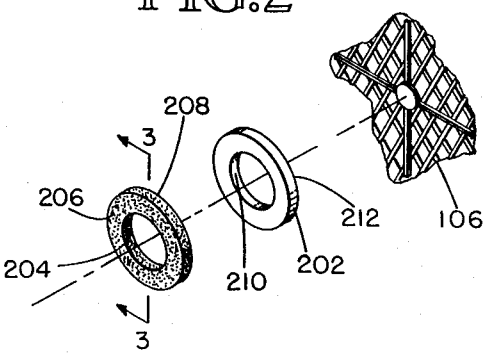
FIG. 2 is an exploded perspective view of the apparatus which comprises the present invention and further includes a partial view of the standard hand-held hair dryer to which the apparatus is adapted to be attached.

A pad assembly 112 is shown attached to the barrier 106 of the hair dryer 100. With reference to FIG. 2, a more detailed description of the pad assembly may be provided. The pad assembly 112 comprises a pad portion 200 and a backing portion 202. The pad portion is a generally circular disc shaped pad which is sized to fit within the aperture 104 of the hair dryer 100. The pad portion is provided for absorbing a scented liquid which is evaporated by the heated air stream and is thereby released to provide a scented air stream for deodorizing the salon.

The pad portion 200 of the pad assembly also includes an aperture 204 through which a portion of the heated air stream can flow. The aperture 204 allows for greater contact between the pad portion 200 and the heated air stream thereby allowing for more scent to be evaporated into the heated air stream and, provided to the beauty salon. It will be appreciated by those skilled in the art that while the pad portion 200 of FIG. 2 is shown as including a single aperture therein, a plurality of smaller apertures may be provided spaced about the pad portion 200.

The pad portion 200 includes first and second opposing sides 206 and 208, respectively. The first side 206 of the pad portion is adapted to face away from the hair dryer 100 when the pad is mounted to the barrier 106. The second side 208 of the pad portion 200 is attached to the backing 202. The backing 202 is sized and shaped to match the second side 208 of the pad portion 200. Accordingly, while the backing 202 is shown to have a generally circular disc shape, the backing may be provided with any size and shape as the second side 208 of the pad 200.

The backing 202 also includes an aperture 210 which is coaxial with the aperture 204 of the pad 200 and is also equal in size to the aperture 204. Like the aperture 204, the aperture 210 is provided for allowing greater contact between the heated air stream and the surface of the pad portion 200. When the pad portion 200 is constructed with a plurality of apertures, it is desirable to provide the backing 202 with a similar plurality of matching apertures such that the heated air stream can flow first through the apertures of the backing 202 then through the apertures of the pad portion 200.

The backing 202 includes an outer surface 212 which faces the barrier 106 of the hair dryer 100. The outer surface 212 of the backing 202 has disposed thereon an adhesive material designed to stick to the barrier 106 and thereby mount the backing 202 and the attached pad portion 200 to the barrier 106 of the hair dryer 100. A particular advantage to including apertures 204 and 210 within the pad portions 200 and the backing 202, respectively, is that with apertures the heated air stream does not supply as great a force to the pad assembly as is applied without apertures and, hence, the pad assembly adheres better to the barrier 106 of the hair dryer 100.

Figure 3:
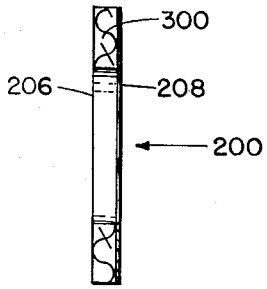
FIG. 3 is a sectional view of the pad which comprises the subject invention, taken along lines 3—3 of FIG. 2.

A sectional view of the pad portion 200 is provided in FIG. 3. Therein, the pad portion 200 is shown to comprise a fibrous material 300. The material 300 is preferably a material which at least partially absorbs liquid. In using the pad assembly of the present invention, a scented liquid material is applied to the pad portion 200 of the pad assembly. It is desirable that the pad portion absorb at least a portion of the scented material such that the material may later be released in the heated air stream. It is noted that by applying the pad assembly to the air aperture 104 from which the heated air stream is supplied, the heat of the air stream aids in evaporating the liquid scented material and thereby more effectively scent the salon.

In the presently preferred embodiment, the scented liquid material which is disposed within and absorbed by the pad portion 200 comprises an oil based perfume. Oil based perfumes have provided significantly better performance than alcohol based perfumes since the oil resists immediate evaporation and hence supplies scent to the heated air stream for longer periods of time. Although oil based perfumes are described as being preferred herein, many other scented liquids may be substituted therefor, especially those liquids which resist evaporation. Also in the presently preferred embodiment, the pad portion 200 as well as the backing 202 are comprised of a flame retardant material. Such composition provides safety against flame and resulting fire when using the pad assemblies disclosed herein. Those skilled in the art will recognize that many types of material can be selected for the pad 200 and the backing 202 which will be liquid absorbent and flame retardant.

In a further embodiment of the invention, the pad assembly may be supplied with a protective covering applied to the other surface of the backing 202 to protect the adhesive and prevent the pad from being inadvertently attached to objects other than the hair dryer barrier 106. In such an embodiment, it is desirable that the protective covering be sized and shaped to match that of the outer surface of the backing 202. It is also desirable that the protective covering be removable from the backing prior to mounting of the pad assembly to the barrier of the hair dryer.

It will be appreciated that, although specific embodiments of the invention have been described herein for purposes of illustration, various modifications may be made without departing from the spirit and scope of the invention. Accordingly, the invention is not limited except as by the appended claims.

I claim:

1. Apparatus for providing a scent to areas wherein a hair dryer is used, the hair dryer being of the standard, hand-held type having an aperture for supplying a stream of heated air and including a barrier for preventing objects from entering into or passing out of the aperture, the barrier including an outer portion which is securely attached to the hair dryer aperture and an interior portion through which the heated air stream passes, said apparatus comprising:

a disc shaped pad made of a flame retardant material which at least partially absorbs liquid, said pad having a circular shape sized to fit within the aperture of the hair dryer and having at least one aperture through which a portion of the air stream can pass, said pad having a first side which faces outward from the hair dryer when said pad is mounted to the hair dryer and a second side which faces the hair dryer when said pad is mounted thereto;

a backing attached to said second side of said pad, said backing being sized and shaped to match said second side of said pad and having an outer surface which faces away from said pad, said outer surface having an adhesive material disposed thereon such that when pressed against the barrier of the hair dryer aperture said backing attaches said pad to the barrier by said adhesive, said backing including at least one aperture being aligned with said at least one aperture of said pad to allow a portion of the heated air stream to pass therethrough;

a protective covering attachable to said outer surface of said backing to protect said adhesive and prevent said pad from being inadvertently attached to objects other than the hair dryer barrier, said protective covering being sized and shaped to match said backing and being removable from said backing prior to mounting of said pad to the barrier of the hair dryer; and an oil based, scented liquid disposed within and absorbed by said pad.

2. Apparatus for providing a scent to areas wherein a hair dryer is used, the hair dryer being of the standard, hand-held type having an aperture for supplying a stream of heated air and including a barrier for preventing objects from entering into or passing out of the aperture, the barrier including an outer portion which is securely attached to the hair dryer aperture and an interior portion through which the heated air stream passes, said apparatus comprising:

a scentable pad sized to fit within the aperture of the hair dryer, said pad having at least one aperture through which a portion of the heated air stream can pass and having first and second opposing sides;

a backing attached to said second side of said pad, said backing being sized to match said second side of said pad and having an outer surface which faces away from said pad, said outer surface having an adhesive material disposed thereon such that when pressed against the barrier of the hair dryer aperture said backing attaches said pad to the barrier by said adhesive, said backing including at least one aperture being aligned with said at least one aperture of said pad to allow a portion of the heated air stream to pass therethrough; and a protective covering attachable to said outer surface of said backing to protect said adhesive and prevent said pad from being inadvertently attached to objects other than the hair dryer barrier, said protective covering being sized to match said outer surface of said backing and being removable from said backing prior to mounting of said pad to the barrier of the hair dryer.

3. Apparatus as recited in claim 2 wherein said pad is further comprised of a flame retardant material which at least partially absorbs liquid.

4. Apparatus as recited in claim 3 further comprising an oil based scented liquid disposed within and absorbed by said pad.

5. Apparatus as recited in claim 2 wherein said pad, said backing and said protective covering each have the same circular shape.

6. Apparatus for providing a scent to areas wherein a hair dryer is used, the hair dryer being of the standard, hand-held type having an aperture for supplying a stream of heated air and including a barrier for preventing objects from entering into or passing out of the aperture, the barrier including an outer portion which is securely attached to the hair dryer aperture and an interior portion through which the heated air stream passes, said apparatus comprising:

a scentable pad having first and second opposing sides;

a backing attached to said second side of said pad and having an outer surface which faces away from said pad, said outer surface having an adhesive material disposed thereon such that when pressed against the barrier of the hair dryer aperture said backing attaches said pad to the barrier by said adhesive.

7. Apparatus as recited in claim 6 wherein said pad and said backing include coaxial apertures through which at least a portion of the heated air stream can pass when said pad is mounted to the hair dryer barrier.

8. Apparatus as recited in claim 6 further comprising a protective covering attachable to said outer surface of said backing to protect said adhesive and prevent said pad from being inadvertently attached to objects other than the hair dryer.

9. Apparatus as recited in claim 8 wherein said pad, said backing and said protective covering include coaxial apertures through which at least a portion of the heated air stream can pass when said pad is mounted to the hair dryer barrier.

10. Apparatus as recited in claim 9 wherein said pad is further comprises of a flame retardant material which at least partially absorbs liquid, said apparatus further comprising an oil based scented liquid disposed within and absorbed by said pad.

* * * * *